US007154465B2

(12) United States Patent
Kim et al.

(10) Patent No.: US 7,154,465 B2
(45) Date of Patent: Dec. 26, 2006

(54) MULTI-LINE SELECTION DRIVING METHOD FOR A SUPER-TWISTED NEMATIC LIQUID CRYSTAL DISPLAY HAVING LOW-POWER CONSUMPTION

(75) Inventors: Bong-nam Kim, Suwon (KR); Hyung-seok Kim, Pusan Metropolitan (KR)

(73) Assignee: Samsung Electronics, Co., Ltd., Suwon (KR)

( * ) Notice: Subject to any disclaimer, the term of this patent is extended or adjusted under 35 U.S.C. 154(b) by 534 days.

(21) Appl. No.: 10/738,414

(22) Filed: Dec. 17, 2003

(65) Prior Publication Data

US 2004/0150608 A1 Aug. 5, 2004

(30) Foreign Application Priority Data

Dec. 31, 2002 (KR) ..... 10-2002-0087886

(51) Int. Cl.
*G09G 3/36* (2006.01)

(52) U.S. Cl. ..... 345/98; 345/94

(58) Field of Classification Search ..... 345/87–89, 345/94–100, 208–211
See application file for complete search history.

(56) References Cited

U.S. PATENT DOCUMENTS 5,481,651 A * 1/1996 Herold ..... 345/94
5,900,857 A * 5/1999 Kuwata et al. ..... 345/100
5,929,832 A * 7/1999 Furukawa et al. ..... 345/98
5,959,603 A * 9/1999 Ito et al. ..... 345/100
5,963,189 A * 10/1999 Ito et al. ..... 345/100
6,040,826 A * 3/2000 Furukawa ..... 345/534
6,084,563 A * 7/2000 Ito et al. ..... 345/100

* cited by examiner

*Primary Examiner*—Xiao Wu
(74) *Attorney, Agent, or Firm*—F. Chau & Associates, LLC

(57) ABSTRACT

A driving unit for an STN-LCD receives input image data and generates column signal functions for selected row lines according to on/off states of pixels, and row signal functions for the selected row lines according to negative/positive states of row signals. The driving unit determines a dot product value of the column signal function and the row signal function to find a mismatch value between the column signal function and the row signal function, and determines the total number of mismatch values corresponding to the row and column signals to be applied sequentially to the liquid crystal panel. The driving unit generates column signal voltages in a first driving time period T1 determined according to the total number of mismatch values, and applies the column signal voltages in period T1 to the column lines when the row signals are applied respectively to four row lines during the period T1.

14 Claims, 3 Drawing Sheets

FIG. 5

TIME

| | C1 | C2 | C3 | C4 |
|---|---|---|---|---|
| R1 | V2 | VM | V2 | VM |
| R2 | V2 | VM | V2 | VM |
| R3 | V2 | V2 | MV2 | VM |
| R4 | V2 | VM | MV2 | V2 |

FIRST DRIVING TIME PERIOD

TIME

| | C1 | C2 | C3 | C4 |
|---|---|---|---|---|
| R1 | VM | VM | VM | VM |
| R2 | VM | VM | VM | VM |
| R3 | VM | V2 | MV2 | VM |
| R4 | VM | VM | MV2 | V2 |

SECOND DRIVING TIME PERIOD

MULTI-LINE SELECTION DRIVING METHOD FOR A SUPER-TWISTED NEMATIC LIQUID CRYSTAL DISPLAY HAVING LOW-POWER CONSUMPTION

BACKGROUND OF THE INVENTION

1. Field of the Invention

The present invention relates to a Super-Twisted Nematic Liquid Crystal Display (STN-LCD), and more particularly, to a Multi-Line Selection (MLS) driving method for a Super-Twisted Nematic liquid crystal display (STN-LCD).

2. Discussion of Related Art

Due to the low response rate of liquid crystal, it can be difficult to implement a moving picture on a Super-Twisted Nematic Liquid Crystal Display (STN-LCD). For this reason, a liquid crystal with a high response rate, e.g., below 50 msec, has been actively researched and the response rate of liquid crystal has been substantially improved. Accordingly moving images of a certain quality, e.g., frame rate,—level can be implemented in STN-LCD using such an improved liquid crystal.

The Alt-Pleshko Technique (APT) driving method is an example of a method for driving the STN-LCD. One disadvantage of the APT driving method is a "Frame Response", in which voltages applied to pixels become gradually smaller due to a leakage current, etc. The frame response induces flickers, and the flickers decrease picture quality. To solve this problem, a Multi-Line Selection (MLS) driving method for driving the STN-LCD was developed for displaying high resolution moving images.

According to the MLS driving method, which simultaneously drives a plurality of rows, it is possible to reduce the flickers generated due to the "Frame Response". In the MLS method, orthogonal row signals are simultaneously applied to selected row lines, and a period of time taken when image signals are applied to the pixels is longer than in the APT method. As the number of simultaneously selected lines increases, picture quality improves, however the driving circuit thereof is more complicated.

Considering the trade-off between the improvement of picture quality and the complexity of driving circuit, a Four Row Line Simultaneous Selection driving method was developed. The four row line simultaneous selection driving method is a method that simultaneously selects and drives four row electrodes. This driving method applies orthogonal row signals to the row lines, that is, alternately applying a positive voltage (+VR) and a negative voltage (−VR) to frames to reduce crosstalk by not applying a DC voltage to the liquid crystal.

FIG. 1 shows the waveforms of a row signal and a column signal for describing the multi-line selection (MLS) driving method used to drive a typical STN-LCD.

With reference to FIG. 1, the multi-line selection (MLS) driving method is a method for applying pixel voltages to liquid crystal, by applying pre-determined column signals (V1–V5) to respective column lines when orthogonal row signals are applied to alternate row lines of a set of four row lines. Here, the respective row lines are selected many times in one frame. Upon the application of a column signal, a plurality of pixel voltages are generated as the difference between the row signal voltage and column signal voltage. A picture image is implemented by turning on/off liquid crystal cells according to root mean square (RMS) values of the varied pixel voltages. Since the RMS values of the pixel voltages determine the on/off states of the liquid crystal cells, levels of the column signal voltages to be applied to the column lines are pre-determined and simultaneously input to the column lines while the row signals are applied to the respective row lines. Combinations of the column signal voltages (V1–V5) and the row signal voltages are created, and RMS values for one frame obtained according to the combinations determine the on/off states of the liquid crystal cells therein.

However, a problem exists in that the conventional MLS driving method used to drive an STN-LCD needs five voltage levels in a column driving circuit, which increases power consumption and makes the driving circuit thereof complicated, in the case where four row lines are simultaneously selected.

SUMMARY OF THE INVENTION

According to an embodiment of the present invention, a multi-line selection (MLS) driving method for driving a Super-Twisted Nematic Liquid Crystal Display (STN-LCD) uses column signal voltages having three levels in a four row-line simultaneous selection driving method.

According to an embodiment of the present invention, a multi-line selection driving method, used to drive an STN-LCD, is implemented by a driving unit that simultaneously selects four row lines and drives a STN liquid crystal panel. The multi-line selection driving method comprises generating, from the driving unit, predetermined column signal voltages in a first driving time period determined according to a total number of mismatch values, and applying the predetermined column signal voltages in the first driving time period to the column lines when the row signals are applied respectively to the four row lines during the first driving time period. Also, the driving unit generates predetermined column signal voltages in a second driving time period determined according to the total number of mismatch values, and applies the predetermined column signal voltages in the second driving time period to the column lines when the row signals are input respectively to the four row lines during the second driving time period.

The predetermined column signal voltages in the first driving time period include column signal voltages having three levels. The predetermined column signal voltages according to the total number of mismatch values are shown in Table 1.

The first driving time period and the second driving time period have the same time length. The first and second driving time periods are determined by the Equation, $$T1:T2=(2b+1):(2b+3)$$

$$b=VR/VC,$$

wherein T1 is the first driving time period, T2 is the second driving time period, VR is an absolute value of the row signal voltage, and VC is ½ of the difference of two levels among the column signal voltages selected from the three levels.

BRIEF DESCRIPTION OF THE DRAWINGS

The above and other features and advantages of the present invention will become more apparent by describing in detail exemplary embodiments thereof with reference to the attached drawings in which:

FIG. 5 is a view for describing row signals and column signals determined according to the dot product values of FIG. 4.

DETAILED DESCRIPTION OF PREFERRED EMBODIMENTS

Hereinafter, preferred embodiments of the present invention will be described in detail with reference to the appended drawings. The same components included in the respective drawings are denoted by the same reference number.

Figure 2:
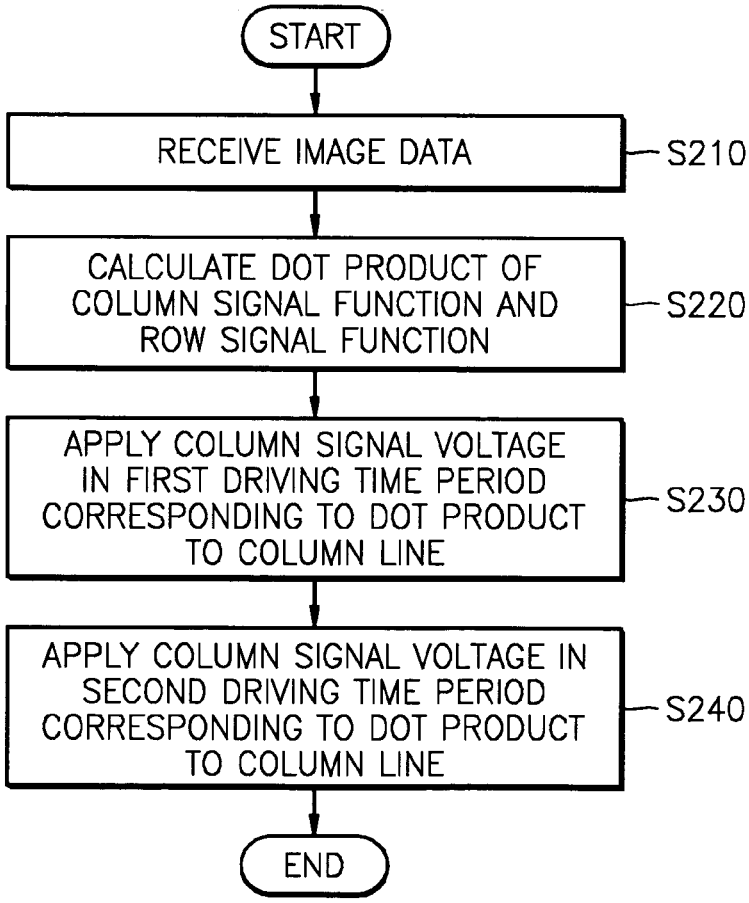
FIG. 2 is a flow chart illustrating a Multi-Line Selection (MLS) driving method used to drive a STN-LCD, according to an embodiment of the present invention.

FIG. 2 is a flow chart illustrating a multi-line selection (MLS) driving method of a Super-Twisted Nematic Liquid Crystal Display (STN-LCD), according to an embodiment of the present invention.

With reference to FIG. 2, the multi-line selection driving method of a driving unit used to drive the STN-LCD will be described hereinafter. The multi-line selection driving method comprises receiving input image data (S210). The image data is black-and-white digital brightness data, but may be, for example, R (red), G (green) and B (blue) digital color data. The receipt of color data is possible because a moving image with a high resolution can be displayed by an STN-LCD having an improved frame response characteristic. The driving unit receives and processes the black-and-white digital brightness data and generates row and column signals for turning on/off liquid crystal cells of the liquid crystal panel.

Figure 3:
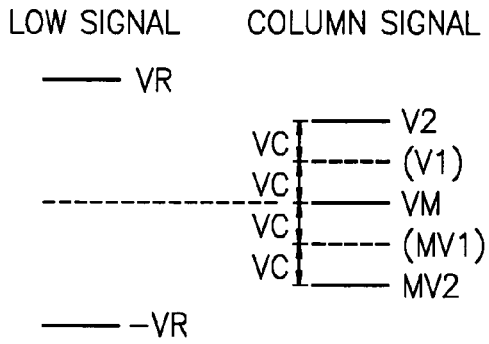
FIG. 3 illustrates voltage levels of the row signal and column signal, which are used for describing the MLS driving method, according to an embodiment of the present invention.

FIG. 3 illustrates voltage levels of the row and column signals, which are used to describe the multi-line selection driving method used to drive an STN-LCD, according to an embodiment of the present invention.

Figure 1:
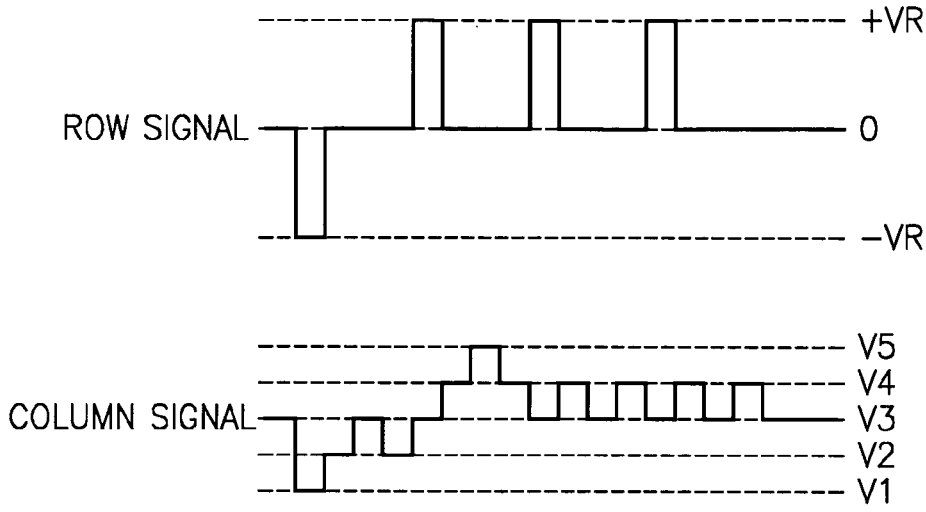
FIG. 1 shows waveforms of a row signal and column signal for describing a multi-line selection (MLS) driving method used to drive a general Super-Twisted Nematic Liquid Crystal Display (STN-LCD)

With reference to FIG. 3, in the multi-line selection driving method used to drive the STN-LCD, the row signal has a negative voltage −VR or a positive voltage +VR, and the column signal has a voltage selected from three levels: MV2, VM and V2. Here, the voltage difference between V2 and VM is 2VC and the voltage difference between VM and MV2 is 2VC. V1 and MV1 are voltages used as V2 and V4 among column signal voltages with five levels, as shown in FIG. 1. That is, in the multi-line selection driving method used to drive the STN-LCD according to the present invention, only three levels, e.g., MV2, VM and V2, are used to drive the STN-LCD. Thus, fewer levels are used to drive the STN-LCD compared to the conventional technique, in which of five levels including V1 and MV1 are used as the voltages of the column signals. Therefore, according to an embodiment of the present invention, it is possible to reduce power consumption and simplify the driving circuit.

The driving unit receiving the input image data generates predetermined column signal functions for selected row lines with different digital values according to the on/off states of pixels, and predetermined row signal functions for the selected row lines with different digital values according to the negative/positive states of the row signals. Also, the driving unit determines a dot product value of the column signal function and the row signal function to find a mismatch value between the column signal function and the row signal function, and determines the total number of mismatch values corresponding to the row and column signals to be applied sequentially to the liquid crystal panel (S220).

Figure 4:
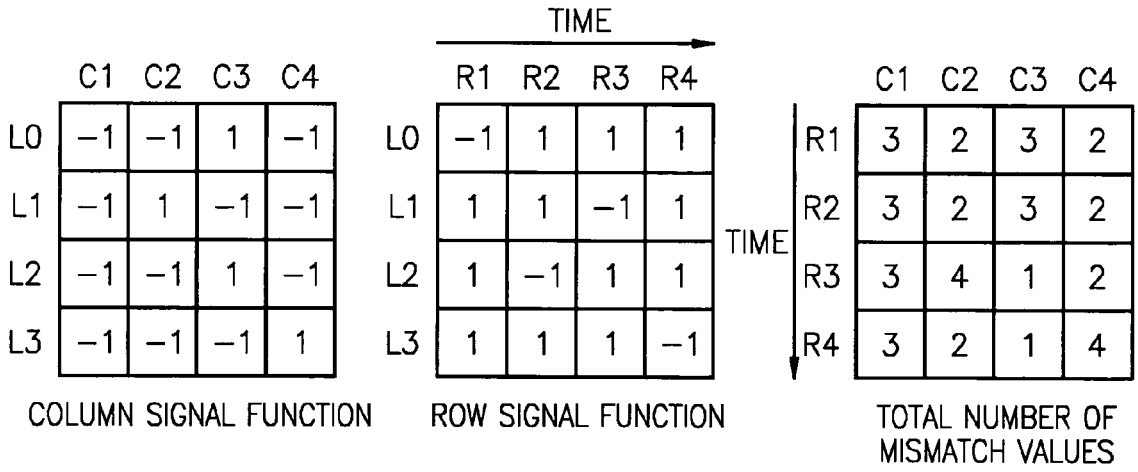
FIG. 4 is a view for describing a dot product calculation of a row signal function and a column signal function used in the multi-line selection driving method used to drive the STN-LCD, according to an embodiment of the present invention.

FIG. 4 is used to describe a dot product determination of the row signal function and the column signal function of the multi-line selection (MLS) driving method used to drive an STN-LCD, according to an embodiment of the present invention.

With reference to FIG. 4, the predetermined column signal functions are function values of column signals C1–C4 with different digital values of "0" or "1" for the selected row lines L0–L3, according to the on/off states of the pixels of the STN-LCD. In FIG. 4, the column signal function value determined for each of the row lines L0–L3 is denoted by "−1" or "1", wherein "−1" represents a pixel is in an "off" state and "1" represents a pixel is in an "on" state. In the off state, the pixel appears to be black because a liquid crystal cell does not transmit light, and in the on state, the pixel appears to be white because a liquid crystal cell transmits light.

Likewise, in FIG. 4, the predetermined row signal functions are function values of the row signals R1–R4, each row signal with a digital value of "0" or "1" for the selected row lines L0–L3, according to the negative/positive state of corresponding row signal. Orthogonal row signals are applied to the row lines to reduce crosstalk by not applying a DC voltage to the liquid crystal. That is, the positive voltage +VR and negative voltage −VR are alternately applied to the row lines in each frame. In FIG. 4 the function values of the row signals, determined respectively for the row lines, are denoted by "−1" or "1", wherein "−1" indicates that a row signal has a negative voltage −VR and "1" indicates that a row signal has a positive voltage +VR. The states of the liquid crystal cells are either on or off depending on the voltage differences between the row signals R1–R4 and column signals C1–C4, which vary with time.

The driving unit determines a dot product value of the column signal function and the row signal function as shown in FIG. 4. The dot product of the two digital values having the same states is "0", that is, the mismatch value between the values is "0", and the dot product of the values having different states is "1", that is, the mismatch value between the values is "1".

In FIG. 4, the total number of mismatch values determined is represented corresponding to the row and column signals to be applied sequentially to the liquid crystal panel. Comparing the column signal functions with the row signal functions for the row lines L0–L3 in a pixel (R1, C1), as shown in FIG. 4, the function values of the row signal and the column signal in the row line L0 at R1 and C1 are both "−1", and the function values of the row signal and the column signal in the row lines L1–L3 at R1 and C1 are different from one another, respectively. Therefore, the total number of mismatch values in a pixel (R1, C1) is "3". In the dot product determination as described above, a mathematical determination (for example, f1 dot f2=f1·f2 cos θ; f1 and f2 are functions values) using a mismatch value angle of 0 degrees and a match value angle of 90 degrees is also possible, considering the respective function values as vector values.

However, when the driving unit determines the total number of mismatch values and dot product value for the digital function values of "0" or "1", it may perform the determination using a combination of logic circuits, such as a XOR (exclusive OR). That is, XOR logic outputs the digital value "1" for two inputs having opposite states, and outputs the digital value "0" for two inputs having same states.

On the basis of the determination result of the dot product values, the driving unit generates predetermined column signal voltages in a first driving time period T1 determined according to the total number of mismatch values, and applies the predetermined column signal voltages in the first driving time period T1 to the column lines when the row signals are input respectively to four row lines during the first driving time period (step S230). Also, the driving unit generates predetermined column signal voltages in a second driving time period T2 determined according to the total number of mismatch values, and applies the predetermined column signal voltages in the second driving time period T2 to the column lines when the row signals are input to the four row lines respectively during the second driving time period. Accordingly, the liquid crystal panel can display an on/off picture corresponding to the input image data. Here, the driving time period T may be a time needed for displaying one frame or one field according to a signal format used in television, and may also be any other time period determined according to a resolution of STN-LCD to be driven or a driving method of STN-LCD. The first driving time period T1 and second driving time period T2 are periods obtained by arbitrarily dividing the driving time period T for one frame by two.

FIG. 5 is a table for describing the row signals and column signals determined according to the dot product values of FIG. 4.

With reference to FIG. 5, the total number of mismatch values determined corresponding to the row signals and column signals in FIG. 4 are represented as column signal voltages having one of three levels MV2, VM, and V2. The column signal voltage levels, which are different from one another according to the driving time periods T1 and T2, are found using Table 1. Referring to FIG. 5, for example, in the case of a pixel (R1, C2), when the voltages of row signals R1 through R4 to be applied to a row line L0 are sequentially changed to −VR, +VR, +VR, and +VR, the voltages of the column signal are sequentially changed to VM, VM, V2, and VM. These voltages are sequentially applied to the row lines and column lines, respectively, and the voltage difference between a row line and a column line, that is, a pixel voltage, is applied to each pixel. The liquid crystal of the pixel displays an on/off state according to the RMS (root mean square) value of this pixel voltage.

TABLE 1

| Total number of mismatch values | Column signal voltage: First driving time period | Column signal voltage: Second driving time period |
|---|---|---|
| 0 | MV2 | MV2 |
| 1 | MV2 | VM |
| 2 | VM | VM |
| 3 | V2 | VM |
| 4 | V2 | V2 |

The pixel voltages to be applied to the pixels in each of the first driving time period T2 and second driving time period T2 are shown by Table 2 and Table 3.

The first driving time period and second driving time period may also be the same time length. Conventionally, the column signal voltage of VR+VC is generally applied during one period. However, according to an embodiment of the present invention, the voltage of VR+2VC is applied during the first driving time period T1 and the voltage of VR is applied during the second driving time period T2. The present invention can obtain the same effect as the conventional technique by making the RMS (root mean square) values of the pixel voltages the same using Equation 1. According to an embodiment of the present invention, the first driving time period and second driving time period are controlled using Equation 2, to compensate the difference of the RMS values.

$$\int_T (VR+VC)^2 = \int_{\frac{T1}{2}} (VR+2VC)^2 + \int_{\frac{T2}{2}} VR^2 \quad (1)$$

$$T1:T2=(2b+1):(2b+3) \quad (2)$$

B=VR/VC, wherein T1 represents the first driving time period, T2 represents the second driving time period, VR represents an absolute value of the row signal voltage, and VC represents ½ of the difference of two levels among the column signal voltages with three levels.

TABLE 2

| Pixel coordinate | | VR + 2VC | VR | VR − 2VC | On/off determination |
|---|---|---|---|---|---|
| R1 | C1 | 1 | | 3 | OFF |
| R1 | C2 | | 3 | 1 | OFF |
| R1 | C3 | 3 | | 1 | ON |
| R1 | C4 | | 3 | 1 | OFF |
| R2 | C1 | 1 | | 3 | OFF |
| R2 | C2 | 1 | 3 | | ON |
| R2 | C3 | 1 | | 3 | OFF |
| R2 | C4 | | 3 | 1 | OFF |
| R3 | C1 | 1 | | 3 | OFF |
| R3 | C2 | | 3 | 1 | OFF |
| R3 | C3 | 3 | | 1 | ON |
| R3 | C4 | | 3 | 1 | OFF |
| R4 | C1 | 1 | | 3 | OFF |
| R4 | C2 | | 3 | 1 | OFF |
| R4 | C3 | 1 | | 3 | OFF |
| R4 | C4 | 1 | 3 | | ON |

TABLE 3

| Pixel coordinate | | VR + 2VC | VR | VR − 2VC | On/off determination |
|---|---|---|---|---|---|
| R1 | C1 | | 4 | | OFF |
| R1 | C2 | | 3 | 1 | OFF |
| R1 | C3 | | 4 | | ON |
| R1 | C4 | | 3 | 1 | OFF |
| R2 | C1 | | 4 | | OFF |
| R2 | C2 | 1 | 3 | | ON |
| R2 | C3 | | 4 | | OFF |
| R2 | C4 | | 3 | 1 | OFF |
| R3 | C1 | | 4 | | OFF |
| R3 | C2 | | 3 | 1 | OFF |
| R3 | C3 | | 4 | | ON |
| R3 | C4 | | 3 | 1 | OFF |
| R4 | C1 | | 4 | | OFF |
| R4 | C2 | | 3 | 1 | OFF |
| R4 | C3 | | 4 | | OFF |
| R4 | C4 | 1 | 3 | | ON |

As described above, according to an embodiment the present invention, a multi-line selection (MLS) driving method of an STN-LCD including a driving unit that simultaneously selects four row lines and drives the STN-LCD is provided. The driving unit receives input image data. The driving unit generates predetermined column signal functions for selected row lines, the predetermined column signal functions having different digital values according to on/off states of corresponding pixels. The driving unit generates predetermined row signal functions for the selected row lines, the predetermined row signal functions having different digital values according to corresponding negative/positive states of the row signals. The driving unit determines a dot product value of the predetermined column function and the row signal function to find a mismatch value between the column signal function and the row signal function. The driving unit further determines the total number of mismatch values corresponding to the row and column signals to be applied sequentially to the liquid crystal panel. Accordingly, the driving unit generates the predetermined column signal voltages in the first driving time period T1 determined according to the total number of mismatch values, and applies the predetermined column signal voltages in the first driving time period T1 to the column lines when the row signals are applied to the four row lines during the first driving time period Also, the driving unit generates the predetermined column signal voltages in the second driving time period T2 determined according to the total number of mismatch values, and applies the predetermined column signal voltages in the second driving time period T2 to the column lines when the row signals are input respectively to the four row lines during the second driving time period. Accordingly, the liquid crystal of each pixel represents an on or off state according to the RMS (root mean square) value of the pixel voltage, thereby allowing the liquid crystal panel to display an on/off picture corresponding to the input image data.

As described the above, the multi-line selection driving method according to an embodiment of the present invention can be performed using three column signal voltages levels in the four row-line simultaneous selection method, thereby reducing power consumption and contributing to circuit simplification.

Particular terms used herein are intended to describe the present invention, but are not intended to limit the present invention or restrict the scope of the present invention. While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A multi-line selection driving method of a driving unit of a super-twisted nematic liquid crystal display for simultaneously selecting four row-lines to drive the super-twisted nematic liquid crystal display, the method comprising:

receiving input image data;

generating predetermined column signal functions for selected row lines, the predetermined column signal functions having different digital values according to on/off states of corresponding pixels of the super-twisted nematic liquid crystal display;

generating predetermined row signal functions for the selected row lines, the predetermined row signal functions having different digital values according to negative/positive states of corresponding row signals;

determining a dot product value of respective pairs the predetermined column signal functions and the predetermined row signal functions to determine a mismatch value between a column signal function and a row signal function;

determining a total number of mismatch values corresponding to the row signals and column signals to be applied sequentially to the super-twisted nematic liquid crystal display;

generating first predetermined column signal voltages in a first driving time period determined according to the total number of mismatch values, and applying the first predetermined column signal voltages in the first driving time period to corresponding column lines when the row signals are input to the four row lines during the first driving time period; and generating second predetermined column signal voltages in a second driving time period determined according to the total number of mismatch values, and applying the second predetermined column signal voltages in the second driving time period to corresponding column lines when the row signals are input to the four row lines during the second driving time period.

2. The multi-line selection driving method of claim 1, wherein the predetermined column signal voltages in the first driving time period include column signal voltages with three levels, and the predetermined column signal voltages, MV2, MV2, VM, V2, and V2, corresponding to the total number of mismatch values, 0, 1, 2, 3 and 4, respectively.

3. The multi-line selection driving method of claim 2, wherein a difference between MV2 and VM is substantially the same as a difference between VM and V2.

4. The multi-line selection driving method of claim 1, wherein the predetermined column signal voltages in the second driving time period include column signal voltages with three levels, and the predetermined column signal voltages, MV2, VM, VM, VM, and V2, corresponding to the total number of mismatch values, 0, 1, 2, 3, and 4, respectively.

5. The multi-line selection driving method of claim 4, wherein a difference between MV2 and VM is substantially the same as a difference between VM and V2.

6. The multi-line selection driving method of claim 1, wherein the first driving time period and the second driving time period have the same time length.

7. The multi-line selection driving method of claim 1, wherein the first and second driving time periods are determined by the Equation, $$T1:T2=(2b+1):(2b+3)$$

B=VR/VC, wherein T1 is the first driving time period, T2 is the second driving time period, VR is an absolute value of a row signal voltage and VC is ½ of the difference of two levels among the column signal voltages with three levels.

8. A program storage device readable by machine, tangibly embodying a program of instructions executable by the machine to perform method steps for simultaneously selecting four row-lines to drive the super-twisted nematic liquid crystal display, the method steps comprising:

receiving input image data;

generating predetermined column signal functions for selected row lines, the predetermined column signal functions having different digital values according to on/off states of corresponding pixels of the super-twisted nematic liquid crystal display;

generating predetermined row signal functions for the selected row lines, the predetermined row signal functions having different digital values according to negative/positive states of corresponding row signals;

determining a dot product value of respective pairs the predetermined column signal functions and the predetermined row signal functions to determine a mismatch value between a column signal function and a row signal function;

determining a total number of mismatch values corresponding to the row signals and column signals to be applied sequentially to the super-twisted nematic liquid crystal display;

generating first predetermined column signal voltages in a first driving time period determined according to the total number of mismatch values, and applying the first predetermined column signal voltages in the first driving time period to corresponding column lines when the row signals are input to the four row lines during the first driving time period; and generating second predetermined column signal voltages in a second driving time period determined according to the total number of mismatch values, and applying the second predetermined column signal voltages in the second driving time period to corresponding column lines when the row signals are input to the four row lines during the second driving time period.

9. The multi-line selection driving method of claim 8, wherein the predetermined column signal voltages in the first driving time period include column signal voltages with three levels, and the predetermined column signal voltages, MV2, MV2, VM, V2, and V2, corresponding to the total number of mismatch values, 0, 1, 2, 3 and 4, respectively.

10. The multi-line selection driving method of claim 9, wherein a difference between MV2 and VM is substantially the same as a difference between VM and V2.

11. The multi-line selection driving method of claim 8, wherein the predetermined column signal voltages in the second driving time period include column signal voltages with three levels, and the predetermined column signal voltages, MV2, VM, VM, VM, and V2, corresponding to the total number of mismatch values, 0, 1, 2, 3, and 4, respectively.

12. The multi-line selection driving method of claim 11, wherein a difference between MV2 and VM is substantially the same as a difference between VM and V2.

13. The multi-line selection driving method of claim 8, wherein the first driving time period and the second driving time period have the same time length.

14. The multi-line selection driving method of claim 8, wherein the first and second driving time periods are determined by the Equation, $$T1:T2=(2b+1):(2b+3)$$

B=VR/VC, wherein T1 is the first driving time period, T2 is the second driving time period, VR is an absolute value of a row signal voltage and VC is ½ of the difference of two levels among the column signal voltages with three levels.

* * * * *